United States Patent [19]

James

[11] Patent Number: 5,025,193

[45] Date of Patent: Jun. 18, 1991

[54] BEAM COLLECTOR WITH LOW ELECTRICAL LEAKAGE

[75] Inventor: Bertram G. James, Redwood City, Calif.

[73] Assignee: Varian Associates, Inc., Palo Alto, Calif.

[21] Appl. No.: 540,409

[22] Filed: Jun. 19, 1990

Related U.S. Application Data

[63] Continuation of Ser. No. 244,546, Sep. 15, 1988, abandoned, which is a continuation of Ser. No. 7,232, Jan. 27, 1987, abandoned.

[51] Int. Cl.[5] ..... H01J 23/027; H01J 23/033

[52] U.S. Cl. ..... 315/5.38; 315/3.5

[58] Field of Search ..... 315/5.38, 5.33, 3.5, 315/3.6, 39.3; 174/25 G, 26 G, 17 GF

[56] References Cited

U.S. PATENT DOCUMENTS

| | | | |
|---|---|---|---|
| 3,271,615 | 9/1966 | Washburn, Jr. | 315/3.5 |
| 3,612,934 | 10/1971 | Henry | 315/3.5 |
| 3,717,787 | 2/1973 | Doyle | 315/5.38 X |
| 3,748,513 | 7/1973 | Levin | 315/5.38 X |
| 3,749,962 | 7/1973 | Smith et al. | 315/3.5 |
| 3,780,336 | 12/1973 | Giebeler | 315/5.38 |
| 3,866,085 | 2/1975 | James | 315/5.38 X |
| 3,903,449 | 9/1975 | Scott et al. | 315/3.5 |
| 3,995,193 | 11/1976 | Horigome et al. | 315/3.5 X |
| 4,071,461 | 1/1978 | Mears et al. | 174/17 GF |
| 4,358,706 | 11/1982 | Nazet et al. | 315/5.38 |

FOREIGN PATENT DOCUMENTS

| | | | |
|---|---|---|---|
| 2906657 | 8/1980 | Fed. Rep. of Germany . | |
| 2045517 | 10/1980 | United Kingdom | 315/3.5 |

*Primary Examiner*—Eugene R. Laroche
*Assistant Examiner*—Seung Ham
*Attorney, Agent, or Firm*—Stanley Z. Cole; Peter J. Sgarbossa; Sheri M. Novack

[57] ABSTRACT

The collector in a linear-beam electron tube is insulated from its heat sink so that it can be operated at a depressed potential. The insulation comprises two bands of dielectric sequentially in contact between the collector and heat sink. The intervening space is sealed off and preferably filled with a dielectric fluid to improve heat transfer and inhibit voltage breakdown. Gaps in one band are preferably aligned with solid parts of the other to reduce electric leakage.

36 Claims, 1 Drawing Sheet

BEAM COLLECTOR WITH LOW ELECTRICAL LEAKAGE

This application is a continuation of application Ser. No. 07/244,546, filed 09-13-88, now abandoned, which is a continuation of application Ser. No. 007,232, filed Jan. 27, 1987, now abandoned.

FIELD OF THE INVENTION

The invention pertains to electron beam tubes such as traveling-wave tubes (TWT's) and klystrons which conventionally have a discrete electrode to collect the beam after it has traversed the interaction circuit which is usually at ground potential. Conversion efficiency of these tubes, particularly TWT's is often improved by biasing negative to ground ("depressed collector") so that the electrons give up kinetic energy before dissipating the remainder on the collector surface. Depression is particularly helpful in millimeter-wave tubes where the inherent interaction efficiency is low due to the high-impedance beams necessary for beam focusing through the tiny circuit, the resultant poor coupling between beam and circuit and tee relatively high circuit losses.

The use of high-voltage, low-current beams makes any electrical leakage from collector to ground a serious fractional loss of power and also masks the measurement of beam current interception on the circuit, which must be minimized to reduce heating of the delicate circuit and maintain the conversion efficiency.

PRIOR ART

When the collector is depressed, the heat generated in it must be transferred through an electrically insulating path to a ground potential heat sink. In large tubes the sink has often been just the air, using cooling fins on the collector in a stream of forced air. In tiny millimeter-wave tubes the insulation between collector and grounded tube body becomes a problem with high, exposed voltages and short leakage paths.

A self-contained depressed-collector design of the prior art as described in U.S. Pat. No. 3,612,934 issued Oct. 12, 1971 to Dominique Henry is shown in FIGS. 1 and 2. This art is described in U.S. Pat. No. 3,612,924 issued Oct. 12, 1971, to Dominique Henry. The TWT is enclosed in a metallic vacuum envelope 10 as of copper. An electron beam 12 from a gun (not shown) traverses an interaction circuit 14, as a helix of tungsten wire supported by a number of dielectric rods 16 as of sapphire inside a copper casing 32 which is part of envelope 10. The terminal end of helix 14 extends out conductor 18 through envelope 10 via an insulating vacuum seal 20. Beam 12, after passage through circuit 14 wherein it is confined to a small cylinder by an axial magnetic field (not shown), expands into hollow collector electrode 22, as of copper. Between collector electrode 22 and envelope 10 are shrink-fitted a plurality of dielectric rods 24 as of beryllium oxide ceramic which provide mechanical support, electrical insulation and thermal conductivity to envelope 10 which is cooled by a grounded heat sink (not shown) such as air fins, liquid channels or a conductive path. Current is supplied to collector 22 by a lead 26 through an insulating vacuum seal 28.

The prior-art collector of FIGS. 1, 2 has some inherent problems. Since the insulating structure is in a high vacuum, thermal conductivity is poor through the small-area contacts to the rods 24. (In vacuum, only radiative transfer is possible except for the tiny areas of atomic-scale physical contact.)

Another problem arising in low-current high-voltage applications such as millimeter-wave tubes is that, in the vacuum, conductive coatings get deposited on the insulating rods. Some metal is evaporated from hot parts, and some sputtering occurs from residual gas in the high electric field. The current leakage across these coatings is increased by the fact that during repeated heating and cooling cycles the compression on the rods may be relieved so that they rotate, exposing fresh faces to the coating processes. Nevertheless, cylindrical rods are widely used because they are easily and cheaply manufactured to close tolerance.

In some prior-art tubes, an attempt was made to reduce leakage by filling the vacant spaces between collector and casing with a dielectric fluid. As described below under embodiments of the present invention, this reduced high-vacuum discharges as causes of conductive layer build-up. However, considerable electrical leakage persisted.

SUMMARY OF THE INVENTION

An object of the invention is to provide a depressed collector with minimized electrical leakage.

A further object is to provide a depressed collector with improved cooling capacity.

A further object is to provide a collector which is cheap and easy to assemble.

A further object is to provide an electron tube in which the collector insulation is installed after the vacuum processing.

These objectives are realized by a collector having two concentric bands of insulators with minimal electrical contact between the two. The bands are preferably disposed so that radial gaps in one band are covered by solid members in the other to minimize series leakage current. In a preferred embodiment, the insulators are contained in a fluid dielectric atmosphere wherein electric discharges which might produce leakage coatings are prevented and heat transfer is enhanced.

DESCRIPTION OF THE PREFERRED EMBODIMENTS

Figure 1:
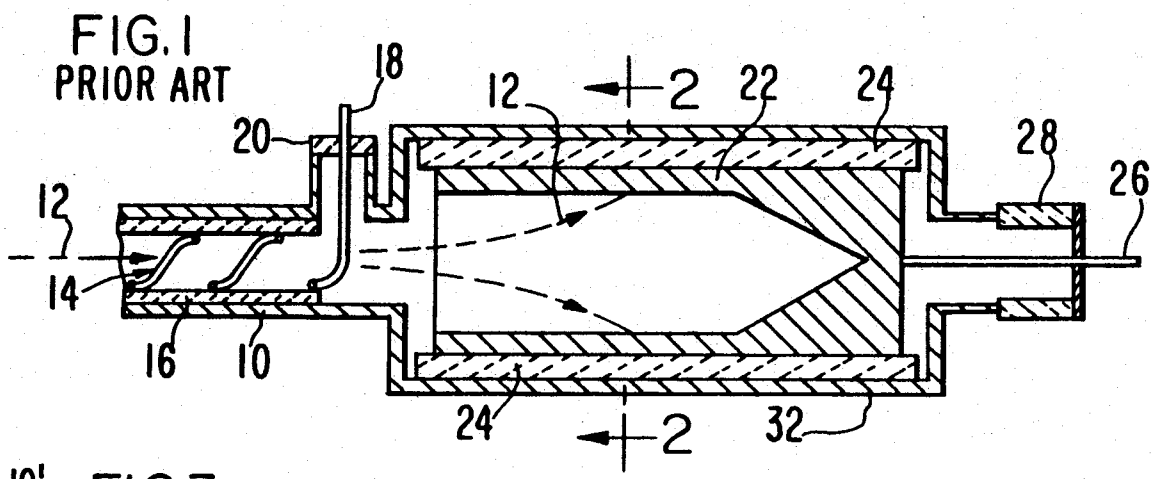
FIG. 1 PRIOR ART
FIG. 1 is a schematic axial cross section of a prior-art insulated collector.
Figure 2:
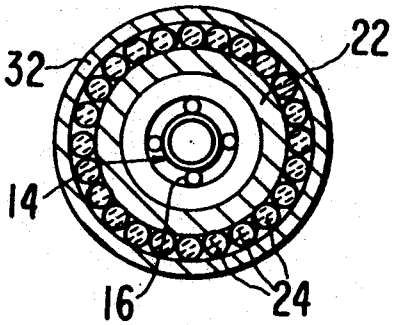
FIG. 2 PRIOR ART
FIG. 2 is a schematic cross section perpendicular to the axis of the collector of FIG. 1.
Figure 3:
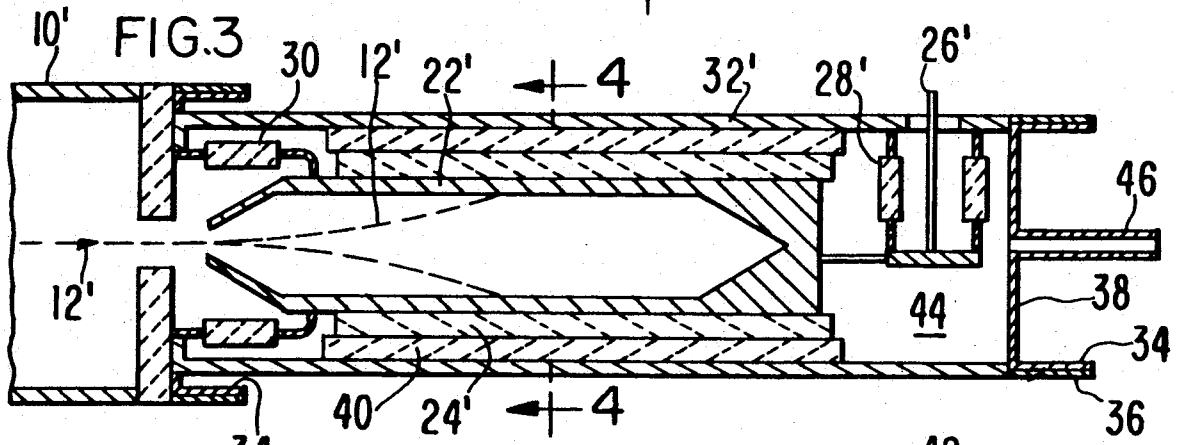
FIG. 3 is a schematic axial section of a collector embodying the invention.
Figure 4:
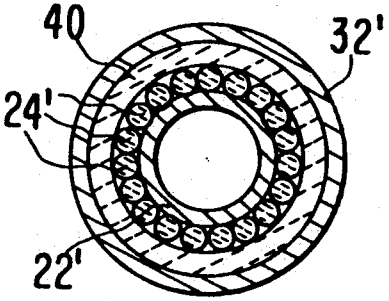
FIG. 4 is a section perpendicular to the axis of the collector of FIG. 3.

FIG. 3 is a schematic section of a collector embodying the invention. Electron beam 12', after passing through the interaction structure (not shown) of a TWT encased in a vacuum envelope 10', enters a hollow beam collector electrode 22' where it expands and is intercepted on the inner wall. Collector 22' is preferably formed with inner and outer surfaces shaped as right circular cylinders, for ease of manufacture and easy cooling. Collector 22' is mounted and sealed off as part of the tube's vacuum envelope 10' by an insulating, hollow, dielectric cylinder 30 as of high-alumina ceramic. The heat generated in collector 22' is carried radially outward to a surrounding casing 32' as of copper. Casing 32' is eventually sealed off by welding lip 34 of an end closure 38 to lip 36 of casing 32'.

The space 44 between collector 22' and enclosure 32' is largely filled by two concentric bands of solid dielectric material 24',40 such as beryllia ceramic which has high thermal conductivity. In the preferred embodiment the inner band is a layer of closely-packed dielectric rods 24', and the outer band is a hollow dielectric cylinder 40. Dielectrics 24',40 fit tightly to optimize thermal conduction.

Electrical connection to collector 22' is brought out by a wire 26' passing through casing 32' via an insulating seal 28'.

Insulating bands 24',40 are preferably inserted after the vacuum processing of the tube to avoid contamination during bake out by volatile materials. Casing 32' is then sealed shut by installing end closure 38. In a succeeding manufacturing step the space 44 between collector 22' and casing 40 is filled via a tubulation 46 with a dielectric fluid such as nitrous oxide which has good thermal conductivity and voltage breakdown, or a halogenated organic gas which has excellent voltage-breakdown characteristics. In applications where breakdown is not a limiting factor, improved thermal transfer may be obtained with a gas of low molecular weight such as hydrogen or helium. Alternatively, a liquid dielectric may be used, but this would be more critical of filling and would present thermal expansion problems. For applications having lower breakdown requirements an air filling may suffice. In any case the dielectric fluid improves heat transfer by adding convection between the close-fitting part. In the prior-art schemes heat transfer occurred only by radiation across the vacuum except through the small areas of actual molecular contact. After filling, space 44 is sealed off by closing tubulation 46.

As discussed under "prior-art", an insulating band 24 can become electrically leaking by being coated with metal from its contact with a metal part 22. As the tube is heated and cooled by intermittent operation, rods such as 24 can become free and rotate during the thermal expansion cycles, making the entire surface somewhat conducting. In the present invention such rods do not contact a second metallic electrode on the side opposite the first, but a second insulator. The formation of a leakage path across the electrically series bridge is inhibited. Preferably the second dielectric band is formed, as by the described cylinder 40, so that if any radial gap surfaces exist, as by accidental thermal cracking as shown by cracks 48 in cylinder 40 of the cylinder, there is only a very small probability that they align with the leakage paths of the first band 24'.

Figure 5:
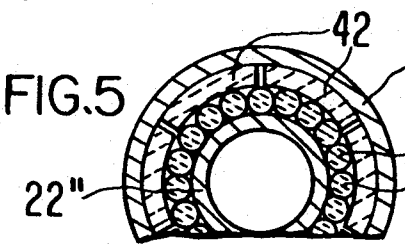
FIG. 5 is a schematic section perpendicular to the axis of a different embodiment.

FIG. 5 is a schematic axial section of an alternative embodiment in which the outer dielectric band is cut into segments 42 to alleviate cracking by thermal stresses. The segments are shaped so as not to rotate during cycling, so radial paths can not be coated by contact and there is small chance of the radial cracks aligning with gaps between inner band cylinders 24''.

Figure 6:
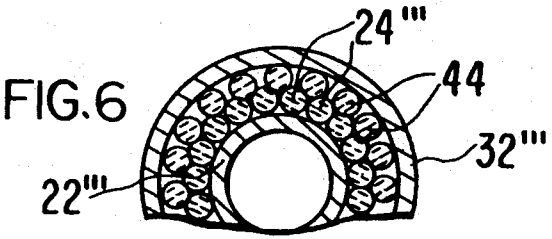
FIG. 6 is a schematic section of another embodiment.
Figure 7:
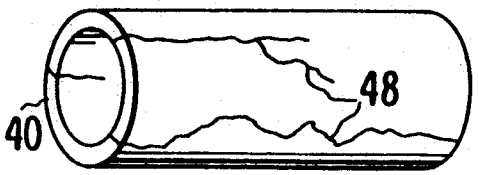
FIG. 7 is a sketch of a collector insulating cylinder with thermal expansion cracks.

FIG. 6 is a schematic axial section of another embodiment. Where thermal transfer is not all-important, the second band may be composed of a second layer of cylindrical rods 44. As described above, these rods are cheap and readily obtainable. The outward leakage paths are broken by the discontinuities between rods, and their gaps are generally not aligned.

It will be obvious to those skilled in the art that many different embodiments can be made within the scope of the invention in addition to the exemplary ones described. The forms of the dielectric elements can be quite diverse. The cylindrical rods 24' are cheap and easily obtainable. For the second band 40 a vast number of shapes may be used. It is only desirable that these elements not be rotatable. It is not completely essential that the insulating space be filled by a dielectric fluid, although this is desirable. The invention is to be limited only by the following claims and their legal equivalents.

I claim:

1. A collector assembly for an electron tube having a vacuum envelope and outer casing comprising:

a conductive hollow collector electrode within said outer casing and spaced therefrom so as to define an annular space radially therebetween;

a first insulative support means at the entrance of said collector supporting said electrode within said casing and isolating said annular space from the vacuum envelope, said annular space being adaptable to confining a special environment differing from that of said vacuum envelope;

a first axially continuous dielectric zone surrounding and in contact with said collector within said isolated annular space;

a second axially continuous dielectric zone surrounding said collector and in contact with said casing and said first dielectric zone;

said zones defining one or more dielectric elements of circular cross-section throughout said entire annular space within said special environment, enhancing thermal transfer while minimizing current flow between collector and outer casing.

2. A collector assembly as in claim 1 in which said special environment comprises a dielectric fluid retained at a pressure different from that of said vacuum envelope.

3. A collector assembly as in claim 1 in which one of said zones is substantially precluded from rotation.

4. A collector assembly as in claim 1 in which the dielectric zones collectively include a plurality of dielectric elements, said annular space being filled with the maximum number possible of said dielectric elements which said space will accept.

5. A collector assembly as in claim 1 in which said second dielectric zone comprises a single tubular dielectric element.

6. A collector assembly as in claim 1 in which said first dielectric zone comprises a plurality of dielectric cylinders filling the remainder of said annular space.

7. A collector assembly as in claim 6 in which said second dielectric zone substantially resists rotation while said cylinders may rotate slightly under thermal stress.

8. A collector assembly as in claim 1 in which said first and second dielectric zones each comprise a plurality of dielectric cylinders, and in which said annular space is packed with the maximum number of such cylinders which can be fitted into said space.

9. In a linear beam electron tube having an electron gun originating an electron beam, an interaction circuit through which said beam travels, and beam collector means, the improvement comprising:

a conductive collector electrode within which said electron beam is terminated, said electrode being capable of being maintained at an electrical potential differing from other elements of the tube;

a vacuum envelope means encasing said interaction circuit and united in fluid-tight relationship with said gun and said collector electrode so as to define a first internal fluid-tight space adapted to be evacuated and embracing the complete path of said electron beam said first space being evacuated;

axial insulator means interposed in vacuum tight relationship between said collector electrode and said vacuum envelope means;

a thermally conductive casing enclosing said collector electrode and being spaced therefrom, said casing and electrode defining therebetween a second internal space separate from said first space and enclosing said collector electrode;

and thermally conductive, electrically insulative means interposed between said casing and said collector electrode within said second space to conduct heat between said electrode and casing, while together with said axial insulator means, preventing flow of electric current therebetween;

said second internal space being adapted to be sealed separately from said first internal space, and to contain said thermally conductive, electrically insulating means within a separate closed fluid-tight environment therein, said second space being at a pressure different from said first space, and in which said insulative means comprise a plurality of elongated, contacting dielectric elements arranged parallel to each other and to the tube axis in a plurality of contacting layers which are tightly packed against each other throughout said second space, to enhance thermal transfer between said electrode and casing while minimizing current flow.

10. The improvement of claim 9, in which said dielectric elements are solid, and in which the remainder of said second space is filled with a dielectric gas at said pressure different from said first space.

11. The improvement of claim 9 in which said plurality of elongated, contacting dielectric elements arranged in a plurality of contacting layers is tightly packed within said second internal space so as to fill said space.

12. The improvement of claim 9, in which said elongated dielectric elements are continuous in the axial direction.

13. The improvement of claim 9, in which one of said layers is comprised of a plurality of identical solid ones of said elongated dielectric elements.

14. The improvement of claim 9, in which said plurality of elongated contacting dielectric elements have cylindrical cross-sections.

15. The improvement of claim 14, in which one of said layers is rendered substantially non-rotational, while the elements of another of said layers may rotate slightly under thermal stress.

16. The improvement of claim 15, in which said non-rotational layer is a tubular dielectric element in contact with the tube casing.

17. The improvement of claim 15, in which said non-rotational element is comprised of a plurality of solid dielectric cylinders.

18. The improvement of claim 15, in which the other of said layers is comprised of solid dielectric cylinders.

19. In a linear beam electron tube having an electron gun originating an electron beam, an interaction circuit through which said beam travels, and beam collector means, the improvement comprising:

a conductive collector electrode within which said electron beam is terminated, said electrode being capable of being maintained at an electrical potential differing from other elements of the tube;

a vacuum envelope means encasing said interaction circuit and united in fluid-tight relationship with said gun and said collector electrode so as to define a first internal fluid-tight space adapted to be evacuated and embracing the complete path of said electron beam;

axial insulating means interposed in vacuum tight relationship between said collector electrode and said vacuum envelope means;

a thermally conductive casing enclosing said collector electrode and being spaced therefrom, said casing and electrode defining therebetween a second internal space separate from said first space and enclosing said collector electrode;

and thermally conductive, electrically insulating means radially interposed between said casing and said collector electrode within said second space and elongated axially to conduct heat between said electrode and casing, while together with said axial insulator means, preventing flow of electric current therebetween;

said second internal space being adapted to be sealed separately from said first internal space and to contain said thermally conductive, electrically insulative means within a separate closed fluid-tight environment therein, said insulative means including inner and outer dielectric zones extending about said collector electrode and being in contact with each other, and with the former also in contact with said casing, and the latter also in contact with the collector electrode, with at least one of said zones being continuous in the axial direction.

20. The improvement of claim 19, in which both said inner and outer dielectrics define thermally continuous bands about said collector electrode.

21. The improvement of claim 19 in which at least said outer dielectric is shaped so as to resist rotation with respect to said casing.

22. The improvement of claim 19 in which said inner dielectric is comprised of a number of discrete, closely spaced, contacting elements, and said outer dielectric is configured to oppose solid portions thereof to discontinuities between said discrete inner elements.

23. The improvement of claim 19, in which said inner and outer dielectric zones together comprise a plurality of axially elongated elements tightly packed within said second internal space.

24. The improvement of claim 23 in which said axially elongated elements are of circular cross-section.

25. The improvement of claim 24, in which one of said zones is substantially precluded from rotation.

26. The improvement of claim 23, in which at least one of said zones comprises a plurality of solid axially elongated elements of circular cross-section.

27. The improvement of claim 19, in which at least one of said zones defines a continuous thermal path around said collector.

28. An electron tube having an electron gun originating an electron beam which defines an axis, an interaction circuit arranged about said axis through which said beam travels, and a beam collector electrode into which said beam terminates and which may be maintained at an electrical potential differing from other elements of the tube, said tube further comprising:

a first conductive casing enclosing said interaction circuit;

a second conductive casing enclosing said beam collector electrode;

axial electrical isolation means for said collector electrode, said means including an insulator axially interposed about said beam path between said collector electrode and first conductive casing, said insulator, electrode and first casing being in fluid-tight relationship to define a first internal environment;

radial electrical isolation means for said collector electrode radially interposed between said electrode and said second casing, said radial isolation means contacting said electrode and second casing over an extended axial distance and providing a thermally conductive path between said electrode and second casing, said radial isolation means including an inner zone of thermally conductive dielectric about said collector electrode, and an outer zone of thermally conductive dielectric about said inner zone, said zones being axially continuous;

said axial electrical isolation means, said second casing, and said collector defining a closed second internal environment containing said radial isolation means;

said first and second casings being joined in electrically continuous relationship, said axial insulator defining, relative to the tube axis, a radially outwardly-facing surface and a radially inwardly-facing surface, said inwardly facing surface being within said first internal environment, with said outwardly facing surface being within said second internal environment.

29. The tube of claim 28, in which said second environment includes a dielectric gas at a pressure of the order of atmospheric pressure.

30. An electron tube having an electron gun originating an electron beam, an interaction circuit through which said beam travels, and a beam collector means which may be maintained at an electrical potential differing from that of other elements of the tube, said tube further comprising:

a first conductive casing portion enclosing said interaction circuit;

a conductive collector electrode within said collector means, and within which said electron beam terminates, said electrode being adapted to be biased at an electrical potential different from that of said interaction circuit;

an insulator axially interposed between said electrode and first casing portion, and joining said collector electrode and first casing portion in gas tight relationship whereby a first evacuated environment about the path of said electron beam is defined;

a second conductive casing portion enclosing said collector electrode and joined to said first casing portion in electrically continuous relationship, to define a second environment;

an axially continuous inner band of thermally conductive dielectric within said second environment and surrounding and in contact with said collector electrode, but spaced from said second casing portion;

and an axially continuous outer band of thermally conductive dielectric within said second environment between and in contact with said second casing portion and said inner band.

31. An electron tube as in claim 30 in which said second casing portion surrounds said axial insulator in radially and axially spaced relationship and joins said first casing at an axial position between said collector and said interaction circuit.

32. An electron tube as in claim 30 in which said inner and outer dielectrics are contained within said second environment, while said axial insulator is contained over one surface thereof in said second environment, and over an opposite surface thereof in said first environment.

33. An electron tube as in claim 32 in which said first environment is essentially evacuated, and said second environment is filled with a dielectric gas.

34. An electron tube as in claim 30 in which said inner dielectric comprises a significantly larger number of discrete elements than said outer dielectric, whereby the probability is minimized of any alignment between an electrical leakage path which may form radially through the inner dielectric with an electrical leakage path which may form radially through the outer dielectric.

35. An electron tube as in claim 30 in which at least said outer dielectric is configured with respect to the second casing portion so as not to rotate with respect thereto.

36. An electron tube as in claim 30 in which at least one of said bands is comprised of parallel dielectrode rods in contact with each other so as to form an essentially continuous layer of dielectric.

* * * * *